US007055942B2

(12) United States Patent
Amma et al.

(10) Patent No.: US 7,055,942 B2
(45) Date of Patent: Jun. 6, 2006

(54) LIQUID DISCHARGE HEAD CARTRIDGE

(75) Inventors: Hiromasa Amma, Tokyo (JP); Wataru Takahashi, Tokyo (JP); Hiroki Hayashi, Tokyo (JP); Masashi Ogawa, Tokyo (JP); Yasuo Kotaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 234 days.

(21) Appl. No.: 10/806,753

(22) Filed: Mar. 22, 2004

(65) Prior Publication Data

US 2004/0189761 A1 Sep. 30, 2004

(30) Foreign Application Priority Data

Mar. 27, 2003 (JP) ..... 2003-087704

(51) Int. Cl.
*B41J 2/175* (2006.01)

(52) U.S. Cl. ..... 347/93; 347/87

(58) Field of Classification Search ..... 347/86, 347/87, 93
See application file for complete search history.

(56) References Cited

U.S. PATENT DOCUMENTS

| | | | | |
|---|---|---|---|---|
| 4,771,295 | A * | 9/1988 | Baker et al. | 347/87 |
| 5,502,479 | A * | 3/1996 | Ishinaga et al. | 347/93 |
| 5,969,739 | A * | 10/1999 | Altendorf et al. | 347/87 |
| 6,082,852 | A * | 7/2000 | Soga et al. | 347/86 |
| 6,325,499 | B1 * | 12/2001 | Betschon | 347/86 |
| 6,592,215 | B1 | 7/2003 | Udagawa et al. | |
| 6,945,643 | B1 * | 9/2005 | Tajima et al. | 347/87 |

FOREIGN PATENT DOCUMENTS

JP 2002-137410 A 5/2002

* cited by examiner

*Primary Examiner*—Anh T. N. Vo
(74) *Attorney, Agent, or Firm*—Canon USA, Inc IP Division

(57) ABSTRACT

A liquid discharge head cartridge can assuredly supply a liquid discharge head with a liquid even when a bubble is generated within a liquid channel, and maintain excellent recording characteristics even in a configuration in which light recovery or no recovery is adopted. The cartridge includes a slit-shaped opening provided at an ink channel facing an ink-jet recording head, a filter provided at an ink introducing unit so as to contact an ink absorber, and ribs for supporting the filter that extend from an inner wall of the ink introducing unit to a substantially central portion of the filter.

10 Claims, 9 Drawing Sheets

Prior Art

LIQUID DISCHARGE HEAD CARTRIDGE

BACKGROUND OF THE INVENTION

1. Field of the Invention

The present invention relates to a liquid discharge head cartridge for recording characters, images and the like on a recording sheet or the like by discharging ink or the like.

2. Description of the Related Art

The configurations of ink-jet recording heads for improving the recording speed of an ink-jet recording apparatus have been disclosed as the shapes of ink introducing units of conventional ink-jet recording cartridges, particularly ink-jet recording heads (e.g., Japanese Patent Application Laid-Open (Kokai) No. 2002-137410).

Ink-jet recording heads of this type have a configuration for maintaining an excellent state of contact between a filter and a pressing member contacting the filter in order to stabilize an ink supply property for the ink-jet recording head, because the flow rate of supplied ink is large.

The above-described conventional ink-jet head will now be described with reference to FIGS. 9A–9D.

FIG. 9A is a plan view illustrating an ink introducing unit of an ink-jet recording cartridge. FIGS. 9B–9D are cross-sectional views of the ink introducing unit shown in FIG. 9A.

A cylindrical ink introducing unit 111 incorporates an ink channel 112 for supplying an ink-jet recording head (not shown) with ink, and a filter 113 fixed at one end portion of the ink channel 112. In the ink introducing unit 111, a plurality of struts 116 for supporting the filter 113 at the end portion of the ink channel 112 are provided, in order to prevent the filter 113 from bending toward the ink channel 112.

A projection having a curved surface is provided at a central portion of the filter 113, and a circumferential portion of the filter 113 is flat. As shown in FIG. 9B, after being mounted on one end portion of the ink channel 112, the filter 113 is fixed on the struts 116 provided at circumferential portions of the end portion by heat welding.

As shown in FIGS. 9C and 9D, the central portion of the filter 113 is subjected to a pressing process so as to form a flat contact surface. A flat contact surface ensures excellent contact between the filter 113 and the pressing member 117, regardless of the surface hardness of the pressing member 117.

Recently, ink-jet recording apparatuses have tended to be smaller in size and lower in cost. Thus, reduction in the size of the apparatus' components and in the production cost is important.

One approach to reducing the size of an ink-jet recording apparatus is to reduce the amount of ink removed by recovery processing (i.e., light recovery processing), as well as reducing the space to accommodate removed ink. One approach to reducing production cost is to completely remove recovery processing (hereinafter referred to as "no recovery").

Recovery processing is performed in order to prevent events like orifices of an ink-jet recording head becoming clogged, or bubbles entering and growing in an ink channel of an ink-jet recording cartridge, where bubble(s) hinder the flow of ink. In particular, in order to remove a bubble from within an ink channel, it is necessary to remove all the ink residing within the ink channel.

In order to achieve the above-described light recovery/no recovery, it is necessary to secure an excellent ink discharge operation without an adverse influence, even if a bubble is present within an ink channel of an ink-jet recording cartridge.

In the above-described conventional ink-jet recording cartridge (for example, refer to Japanese Patent Application Laid-Open Patent No. 2002-137410), recording can be performed with no problems by performing ordinary recovery processing comprising of entirely removing the ink and any bubbles within the ink channel. However, in the conventional ink-jet recording head, when adopting light recovery where light recovery processing is performed only for clogging of an orifice, or no recovery in which no recovery processing is performed, removal of a bubble within the ink channel is not performed. Thus, there the possibility remains that the bubble can block the flow of ink, resulting in decreased recording performance.

In order to prevent blocking of the flow of ink by a bubble, it is necessary to increase the volume of the ink channel and the cross section of the ink channel in a direction perpendicular to the direction of the flow of ink within the ink channel. However, when the diameter of the cross section of the ink channel (i.e., liquid introducing channel) of the ink-jet recording cartridge is simply increased, the positions to provide struts for supporting the filter are limited, resulting in an inability to prevent deformation (e.g., a recess) in the direction of the thickness of the filter.

SUMMARY OF THE INVENTION

It is an object of the present invention to provide a liquid discharge head cartridge, in which a liquid discharge head and an ink tank are integrated, capable of assuredly supplying the liquid discharge head with a liquid even if a bubble is generated within an ink channel of the liquid discharge head cartridge, while maintaining excellent recording characteristics even in a configuration where the above-described light recovery or no recovery is adopted.

According to one aspect of the present invention, a liquid discharge head cartridge includes a liquid discharge head for discharging a liquid, a liquid absorber for holding the liquid, a liquid introducing unit having a liquid channel for supplying the liquid discharge head with the liquid from the liquid absorber, a slit-shaped opening provided at a portion of the liquid channel facing the liquid discharge head, a filter provided at the liquid introducing unit so as to contact the liquid absorber, and a rib extending from an inner wall of the liquid introducing unit to a substantially central portion of the filter, for supporting the filter.

In the liquid discharge head cartridge of the present invention having the above-described configuration, since the rib extending from the inner wall of the liquid introducing unit to the substantially central portion of the filter supports the filter, deformation of the filter toward the liquid channel is prevented. In the liquid introducing unit, since the rib is provided within the liquid channel, hindrance of supply of the liquid by a bubble generated within the liquid channel is prevented. In the liquid introducing unit, in addition to a main flow of the liquid within the liquid channel, another flow of the liquid having a larger capillary force than the main flow is generated along a corner portion made by the inner wall of the liquid introducing unit and a side of the rib. Accordingly, even when a bubble is generated within the liquid channel, the liquid is assuredly supplied to the liquid discharge head by the other flow, and stability of liquid supply is secured.

It is preferable that the rib extends to the opening and that the rib extends in a direction substantially parallel to a long-side direction of the opening. It is also preferable that a plurality of ribs is provided at the liquid introducing unit.

It is preferable that in the liquid introducing unit, a pair of ribs is provided at positions facing across the opening, and an inclined surface for gradually reducing the interval between the facing ribs from the filter toward the opening is formed at each of the ribs.

It is preferable that in the liquid introducing unit, a plurality of ribs extend radially from a substantially central portion of the opening in a long-side direction of the opening. By radially providing the plurality of ribs, in the liquid introducing unit, in addition to the other flow generated along the corner portion made by the inner wall of the liquid introducing unit and the side of the rib, still another flow having a larger capillary force than the main flow within the liquid channel is generated along the inner wall of the liquid introducing unit and a base near the opening. According to these other flows, the liquid is more assuredly supplied to the liquid discharge head even if a bubble is generated within the liquid channel.

According to another aspect of the present invention, a recording apparatus that mounts a liquid discharge head cartridge including a liquid discharge head for discharging a liquid, a liquid absorber for holding the liquid, and a liquid introducing unit having a liquid channel for supplying the liquid discharge head with the liquid from the liquid absorber includes a slit-shaped opening provided at a portion of the liquid channel facing the liquid discharge head, a filter provided at the liquid introducing unit so as to contact the liquid absorber, and a plurality of ribs extending from an inner wall of the liquid introducing unit to a substantially central portion of the filter, for supporting the filter. The plurality of ribs extend in a direction substantially parallel to a long-side direction of the opening.

The foregoing and other objects, advantages and features of the present invention will become more apparent from the following detailed description of the preferred embodiments taken in conjunction with the accompanying drawings.

BRIEF DESCRIPTION OF THE DRAWINGS

FIG. 2A is a plan view illustrating the ink introducing unit; and FIG. 2B is a cross-sectional view taken along line A—A shown in FIG. 2A, illustrating the ink introducing unit;

FIG. 3A is a plan view illustrating the ink introducing unit; and FIG. 3B is a cross-sectional view taken along line A—A shown in FIG. 2A, illustrating the ink introducing unit;

FIG. 5A is a plan view illustrating the ink introducing unit; and FIG. 5B is a cross-sectional view taken along line B—B shown in FIG. 5A, illustrating the ink introducing unit;

FIG. 6A is a plan view illustrating the ink introducing portion; and FIG. 6B is a cross-sectional view taken along line B—B shown in FIG. 5A, illustrating the ink introducing unit;

FIG. 7A is a plan view illustrating the ink introducing unit; and FIG. 7B is a cross-sectional view taken along line C—C shown in FIG. 7A, illustrating the ink introducing unit;

FIG. 8A is a plan view illustrating the ink introducing unit; and FIG. 8B is a cross-sectional view taken along line C—C shown in FIG. 7A, illustrating the ink introducing unit; FIG. 9A is a plan view illustrating the ink introducing unit; FIG. 9B is a cross-sectional view taken along line D—D shown in FIG. 9A, illustrating a state in which a filter is mounted on the ink introducing unit; FIG. 9C is a cross-sectional view taken along line D—D shown in FIG. 9A, illustrating a state in which the filter is connected to the ink introducing unit; and FIG. 9D is a cross-sectional view taken along line D—D shown in FIG. 9A, illustrating a state in which a pressing member contacts the filter.

DETAILED DESCRIPTION OF THE PREFERRED EMBODIMENTS

Preferred embodiments of the present invention will now be described with reference to the drawings.

First Embodiment

Figure 1:
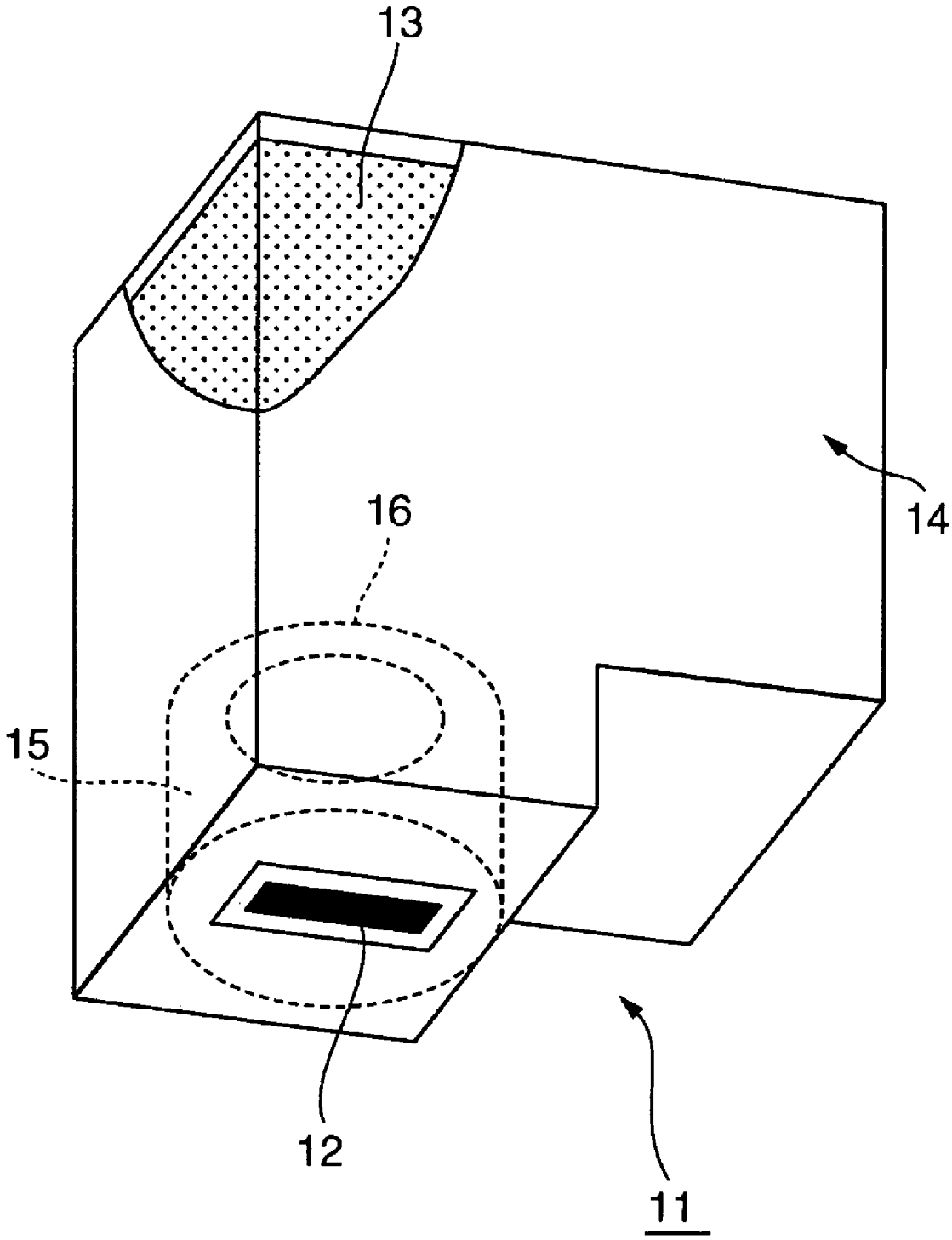
FIG. 1 is a perspective view illustrating an ink-jet recording cartridge according to a first embodiment of the present invention.
Figure 2A:
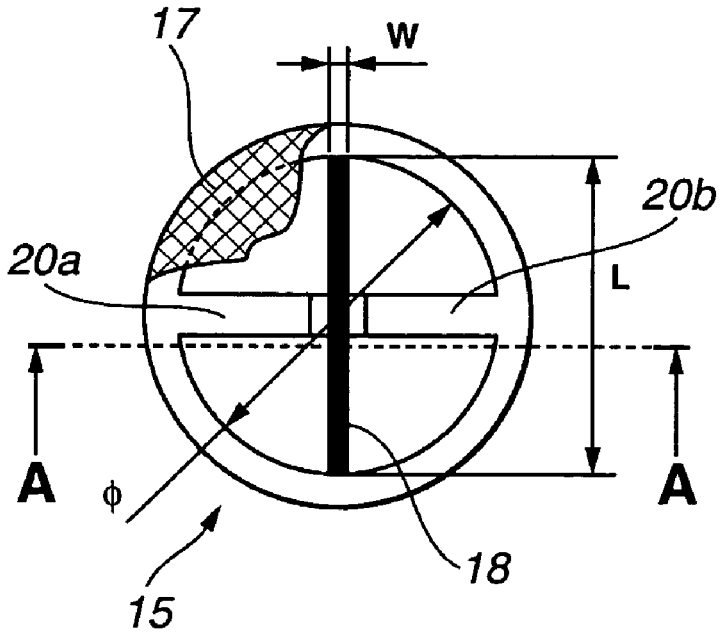
FIGS. 2A and 2B are diagrams illustrating an ink introducing unit of the ink-jet recording cartridge shown in FIG. 1.
Figure 2B:
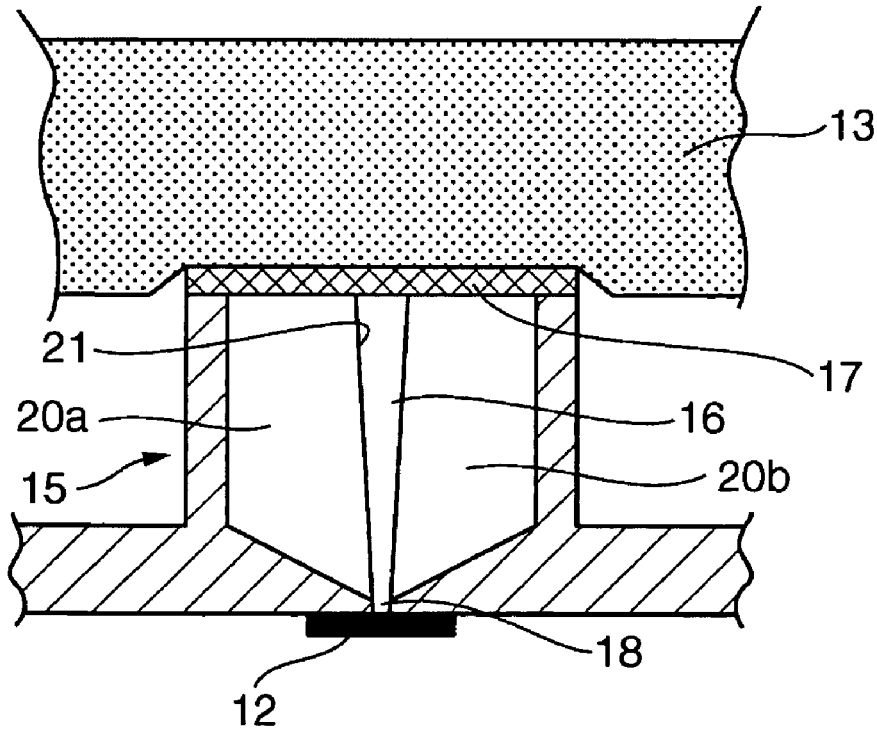

FIG. 1 is a schematic perspective view illustrating an ink-jet recording cartridge according to a first embodiment of the present invention. FIGS. 2A and 2B are diagrams illustrating an ink introducing unit of the ink-jet recording cartridge shown in FIG. 1. FIG. 2A is a plan view in which the ink introducing unit is seen from a filter side, i.e., an ink introducing direction, toward an opening; and FIG. 2B is a cross-sectional view taken along line A—A shown in FIG. 2A.

As shown in FIG. 1, an ink-jet recording cartridge 11 includes an ink-jet recording head 12 for discharging ink (hereinafter referred to as a "recording head"), and an ink-tank unit 14 incorporating an ink absorber 13 for holding ink to be supplied to the recording head 12. Within the ink-jet recording cartridge 11, an ink introducing unit 15 for supplying the recording head 12 with ink from the ink absorber 13 holding ink, via an ink channel 16 is provided between the recording head 12 and the ink absorber 13.

As shown in FIGS. 2A and 2B, the ink introducing unit 15 has the shape of a cylinder with an inner diameter of 12 mm. In the ink introducing unit 15, a filter 17 for removing foreign matter within ink contacts one end of the ink absorber 13.

An opening 18 having the shape of a slit with a width W of 1 mm and a length L of 12 mm is provided at another end of the ink introducing unit 15 facing the recording head 12 so as to surround a nozzle row (not shown) of the recording head 12.

As shown in FIG. 2A, in the ink introducing unit 15, two ribs 20*a* and 20*b* extend from the inner wall surface toward a substantially central portion of the filter 17 so as to be substantially orthogonal to a long-side direction of the opening 18. The ribs 20*a* and 20*b* are formed in a substantially flat-plate shape at positions facing across the opening 18.

As shown in FIG. 2B, one end of each of the ribs 20*a* and 20*b* contacts the filter 17, and another end extends to the opening 18. In each of the ribs 20*a* and 20*b*, an inclined surface 21 for gradually reducing the interval between the ribs 20*a* and 20*b* facing across the opening 18 from the filter 17 toward he opening 18 is formed.

Support by the ribs 20*a* and 20*b* prevents deformation of the filter 17, which allows an excellent state of contact with the ink absorber 13 to be maintained. Due to the presence of the ribs 20*a* and 20*b*, when a bubble (not shown) entering the ink channel 16 grows and occupies a majority of the inside of the ink channel 16, the flow of ink being blocked by the bubble is prevented. Thus, an excellent state of ink supply to the recording head 12 can be maintained.

Since corner portions formed by the inner wall surface of the ink introducing unit 15 and sides of the ribs 20*a* and 20*b* have a larger capillary force than the main flow of ink within the ink channel 16, a second ink flow (i.e., a "second ink channel") 23 having a relatively large force to attract ink from the ink absorber 13 is generated along this corner portion.

Figure 3A:
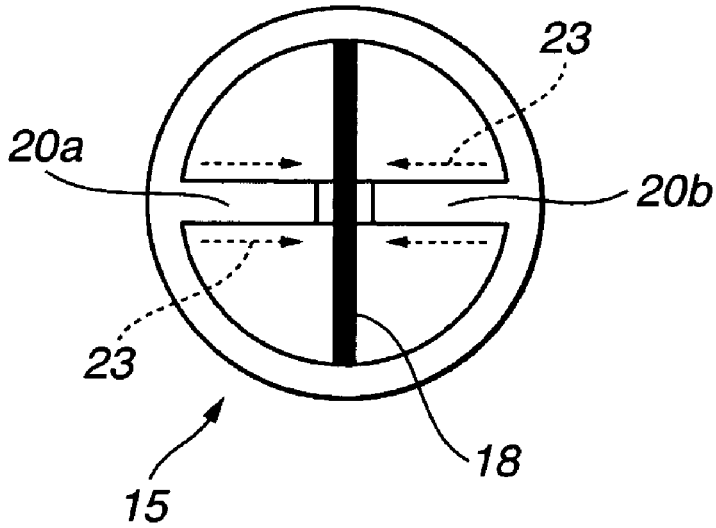
FIGS. 3A and 3B are diagrams illustrating a second ink channel within the ink introducing unit.
Figure 3B:
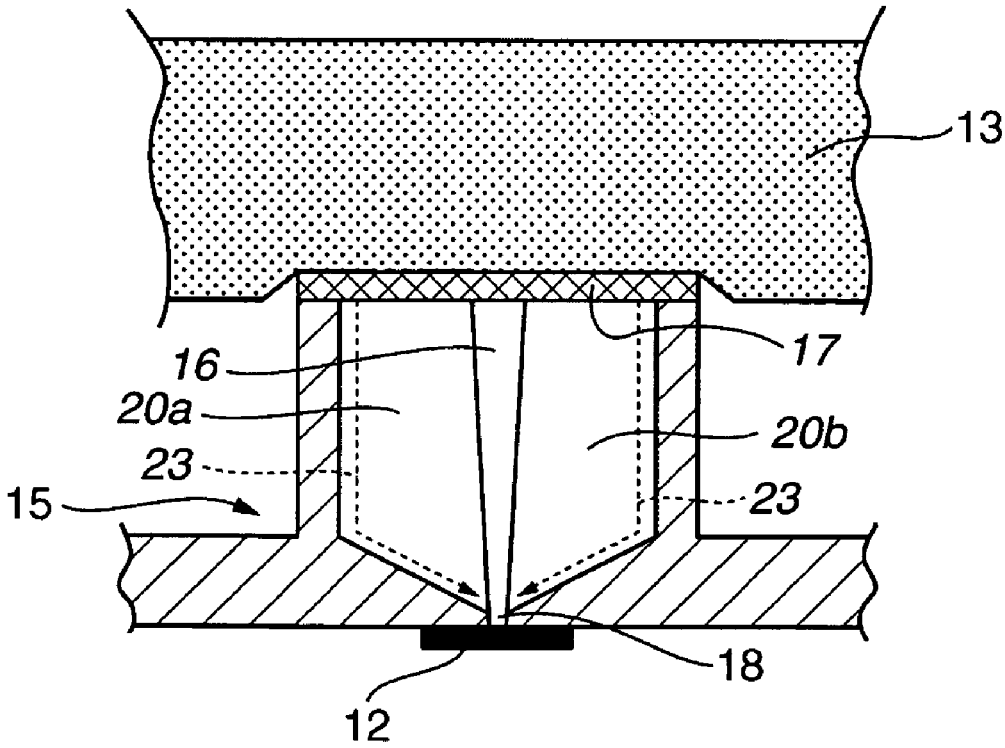

As a result of the existence of this second ink channel 23, even when a bubble (not shown) entering the ink channel 16, which is the main ink channel, grows and occupies a majority of the ink channel 16, ink is supplied, as indicated by arrows represented by broken lines in FIGS. 3A and 3B, by the second ink channel 23, serving as a sub-flow, flowing along sides of the ribs 20*a* and 20*b*. Thus, an excellent state of ink supply to the recording head 12 can be maintained.

Although in the first embodiment, a configuration in which the slit-shaped opening 18 has a width W of 1 mm and a length L of 12 mm, and the ink introducing unit 15 has an inner diameter of 12 mm is adopted, the sizes of the above-described units may have any other appropriate values within a range so as to be able to maintain an excellent state of ink supply in accordance with the sizes of the ink-jet recording cartridge, the ink accommodating unit, the recording head and the like.

As described above, in the ink-jet recording cartridge 11, since the filter 17 is supported by the ribs 20*a* and 20*b* extending from the inner wall of the ink introducing unit 15 to a substantially central portion of the filter 17, deformation of the filter 17 toward the ink channel 16 can be prevented. In the 15, by providing the ribs 20*a* and 20*b* within the ink channel 16, blocking of ink supply by a bubble generated within the ink channel 16 can be prevented. Furthermore, in the ink introducing unit 15, since the second ink channel 23 having a capillary force larger than in the main flow within the ink channel 16 is generated along the corner portion made by the inner wall of the ink introducing unit 15 and sides of the ribs 20*a* and 20*b*, it is possible to assuredly supply ink to the recording head 12, and secure stability of ink supply.

According to the ink-jet recording cartridge 11, it is possible to simultaneously prevent deformation of the filter 17, prevent blocking of ink supply due to a bubble within the ink channel 16, and secure stability of ink supply.

Second Embodiment

Figure 4:
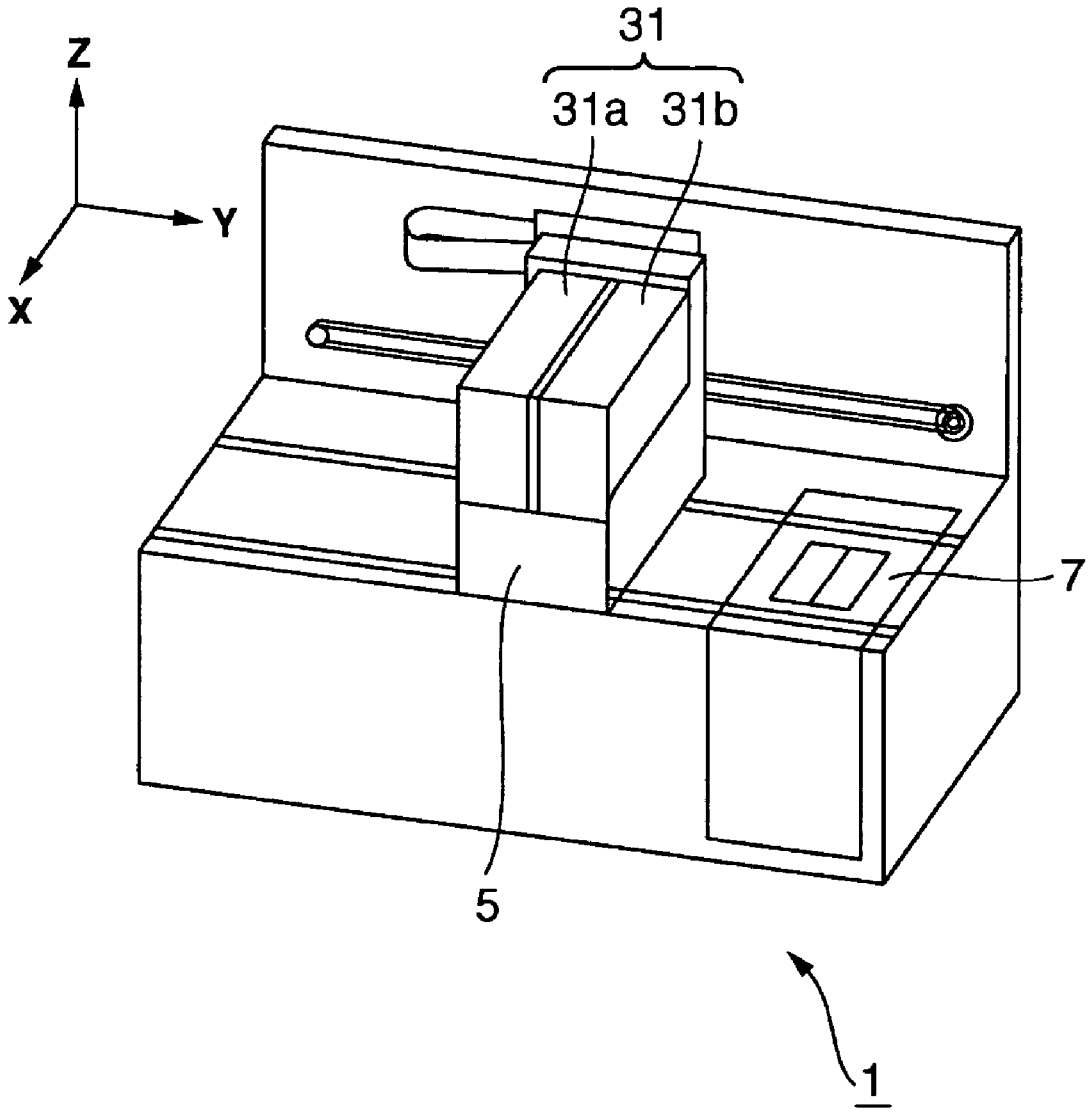
FIG. 4 is a perspective view illustrating a principal portion of an ink-jet recording apparatus including an ink-jet recording cartridge according to a second embodiment of the present invention.

FIG. 4 is a schematic perspective view illustrating a principal portion of a recording apparatus including an ink-jet recording cartridge according to a second embodiment of the present invention. Since the ink-jet recording cartridge of the second embodiment has the same basic configuration as the ink-jet recording cartridge 11 of the first embodiment, the same components as those in the first embodiment are indicated by the same reference numerals, and further description thereof will be omitted.

As shown in FIG. 4, two ink-jet recording cartridges 31 of different types are mounted on a carriage 5 included in an ink-jet recording apparatus 1. The ink-jet recording cartridges 31 include a black-ink cartridge 31*a* mounting black ink, and a color-ink cartridge 31*b* mounting color ink liquids, such as yellow, magenta, and cyan ink liquids.

The carriage 5 is reciprocatable in the Y direction, and performs recovery processing for an ink-jet recording head 12 of the ink-jet recording cartridge 31 using a recovery unit 7 provided at one end portion in the Y direction so as to face the recording head 12.

Figure 5A:
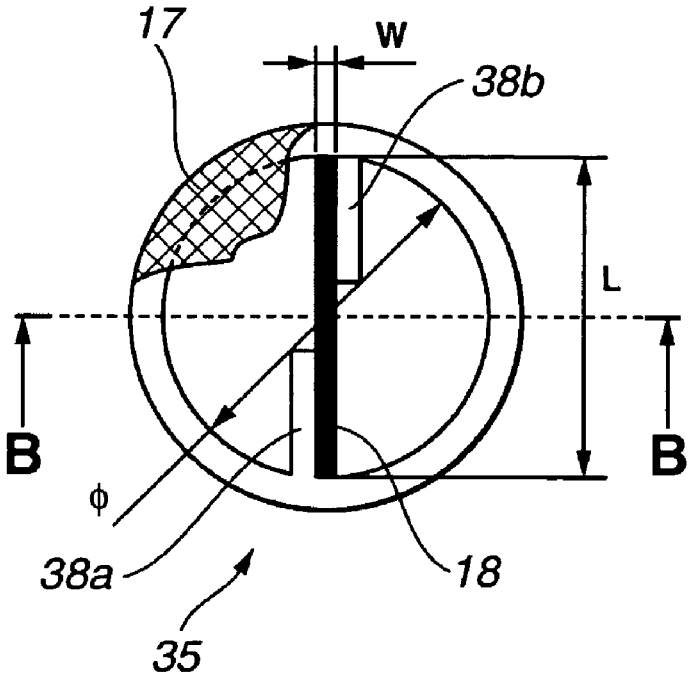
FIGS. 5A and 5B are diagrams illustrating an ink introducing unit of the ink-jet recording cartridge shown in FIG. 4.
Figure 5B:
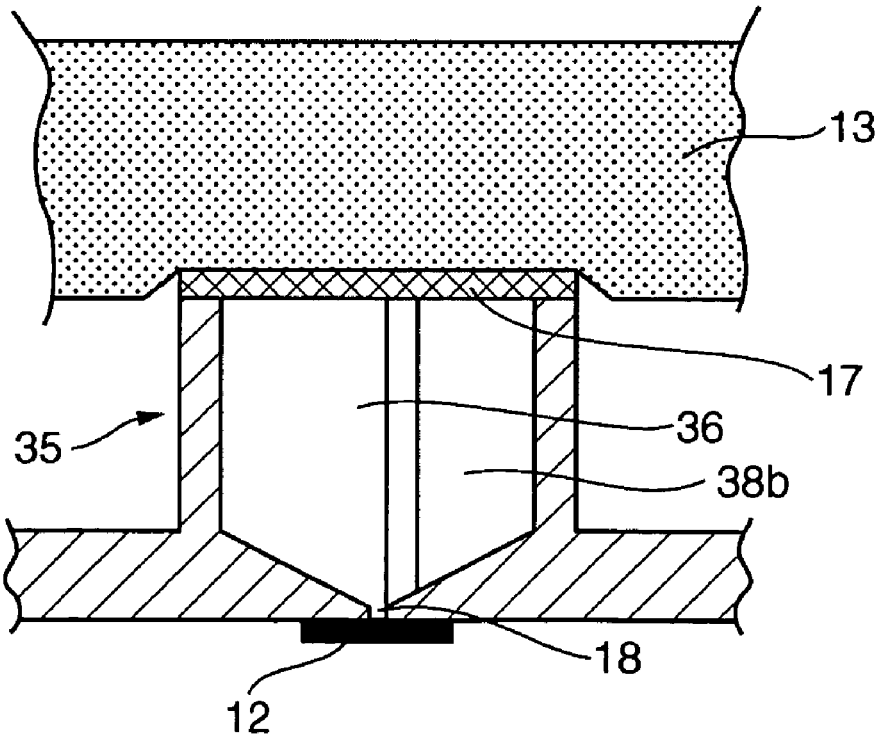

FIGS. 5A and 5B are diagrams illustrating an ink introducing unit of the ink-jet recording cartridge 31. FIG. 2A is a plan view in which the ink introducing unit is seen from a filter side, i.e., an ink introducing direction, toward an opening; FIG. 5B is a cross-sectional view taken along line B—B shown in FIG. 5A.

As shown in FIGS. 5A and 5B, within the ink-jet recording cartridge 31, an ink introducing unit 35 for supplying a recording head 12 with ink from an ink absorber 13 for holding ink, via an ink channel 36 is provided between the recording head 12 and the ink absorber 13.

The ink introducing unit 35 has the shape of a cylinder with an inner diameter of 12 mm. In the ink introducing unit 35, a filter 17 for removing foreign matter within ink contacts one end of the ink absorber 13.

An opening 18 having the shape of a slit with a width W of 1 mm and a length L of 12 mm is provided at another end of the ink introducing unit 35 facing the recording head 12 so as to surround a nozzle row (not shown) of the recording head 12.

As shown in FIG. 5A, in the ink introducing unit 35, two ribs 38*a* and 38*b* extend from the inner wall surface toward a substantially central portion of the filter 17 along corresponding ones of facing long sides of the opening 18, across the opening 18. The ribs 20*a* and 20*b* are formed in a substantially flat-plate shape at symmetrical positions across the opening 18 by extending toward a substantially central portion of the opening 18 in parallel to a long-side direction of the opening 18.

As shown in FIG. 5B, one end of each of the ribs 20*a* and 20*b* contacts the filter 17, and another end extends to the opening 18.

Support by the ribs 38*a* and 38*b* prevents deformation of the filter 17, which allows an excellent state of contact with the ink absorber 13 to be maintained. Due to the presence of the ribs 38*a* and 38*b*, when a bubble (not shown) entering the ink channel 36 grows and occupies a majority of the inside of the ink channel 36, the flow of ink being blocked by the bubble is prevented. Thus, an excellent state of ink supply to the recording head 12 can be maintained.

Since corner portions formed by the inner wall surface of the ink introducing unit 35 and sides of the ribs 38*a* and 38*b* have a larger capillary force than the main flow of ink within the ink channel 36, a second ink channel 39 having a relatively large force to attract ink from the ink absorber 13 is generated along the corner portions.

Figure 6A:
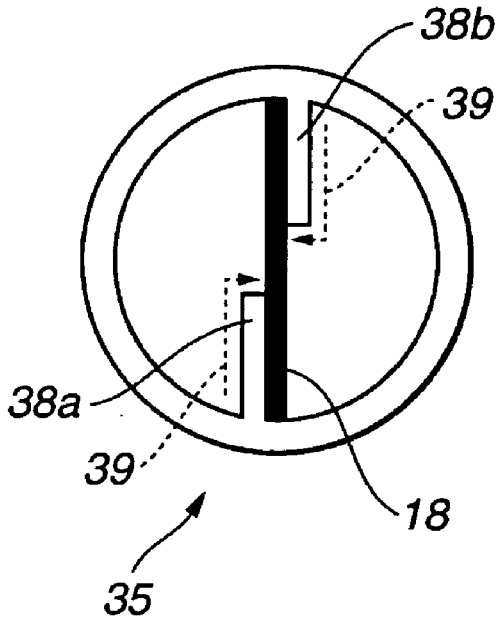
FIGS. 6A and 6B are diagrams illustrating a second ink channel within the ink introducing unit.
Figure 6B:
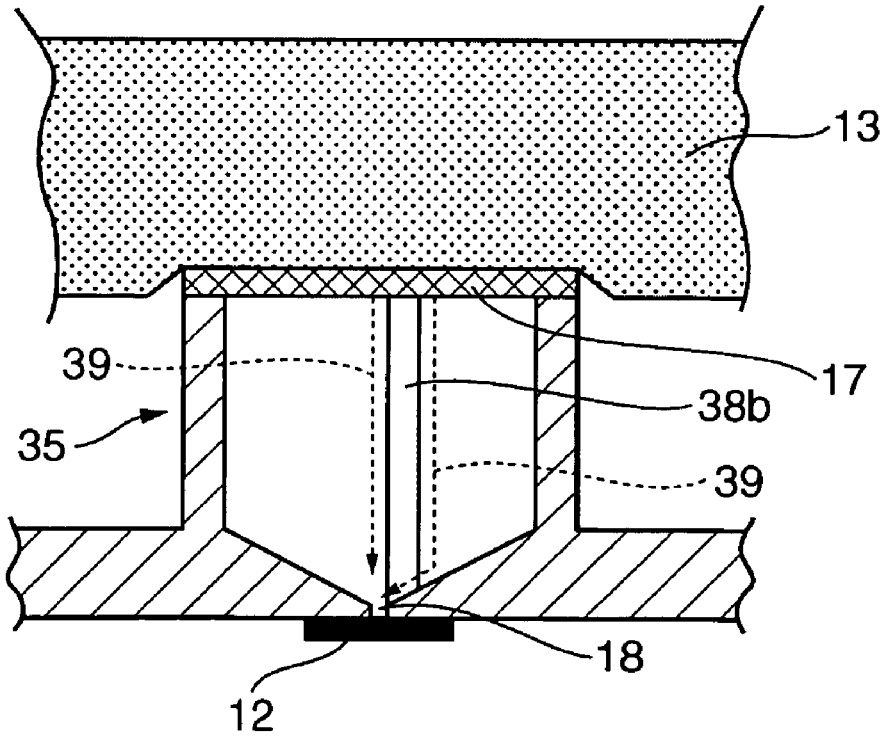

As a result of the existence of this second ink channel 39, even when a bubble (not shown) entering the ink channel 36 grows and occupies a majority of the ink channel 36, ink is supplied by the second ink channel 39, as indicated by arrows represented by broken lines in FIGS. 6A and 6B, and an excellent state of ink supply to the recording head 12 from the ink absorber 13 can be maintained.

The ink-jet recording cartridge 31 is mounted on the ink-jet recording apparatus 1 in a state in which a nozzle row (not shown) of the recording head 12 is parallel to the X direction shown in FIG. 4. As shown in FIG. 5A, since the long side of the opening 18 is parallel to the nozzle row, the carriage 5 is subjected to scanning in the Y direction shown in FIG. 4.

Since the ribs 38*a* and 38*b* extend in a direction orthogonal to the scanning direction of the carriage 5, swung movement of ink (not shown) within the ink channel 38 is suppressed. As a result, in the ink-jet recording cartridge 31, an adverse influence on an ink discharge operation during recording is suppressed by the ribs 38*a* and 38*b*, and ink can be stably discharged.

Although in the second embodiment, a configuration in which the slit-shaped opening 18 has a width W of 1 mm and a length L of 12 mm, and the ink introducing unit 15 has an inner diameter of 12 mm is adopted, the sizes of the above-described units may have any other appropriate values within a range so as to be able to maintain an excellent state of ink supply in accordance with the sizes of the ink-jet recording cartridge, the ink accommodating unit, the recording head, and the like.

As described above, in the ink-jet recording apparatus 1 including the ink-jet recording cartridge, since discharge characteristics are not degraded because ink is excellently supplied even when a bubble is generated within the ink channel, it is possible to reduce the amount of recovery, and adopt a configuration in which a recovery unit is omitted (not shown). Accordingly, the amount of waste ink is reduced, and the size of the ink-jet recording apparatus can be reduced. As a result, the amount of ink that can be used by the user is increased, and by omission of a recovery unit, the production cost can be reduced.

Third Embodiment

Figure 7A:
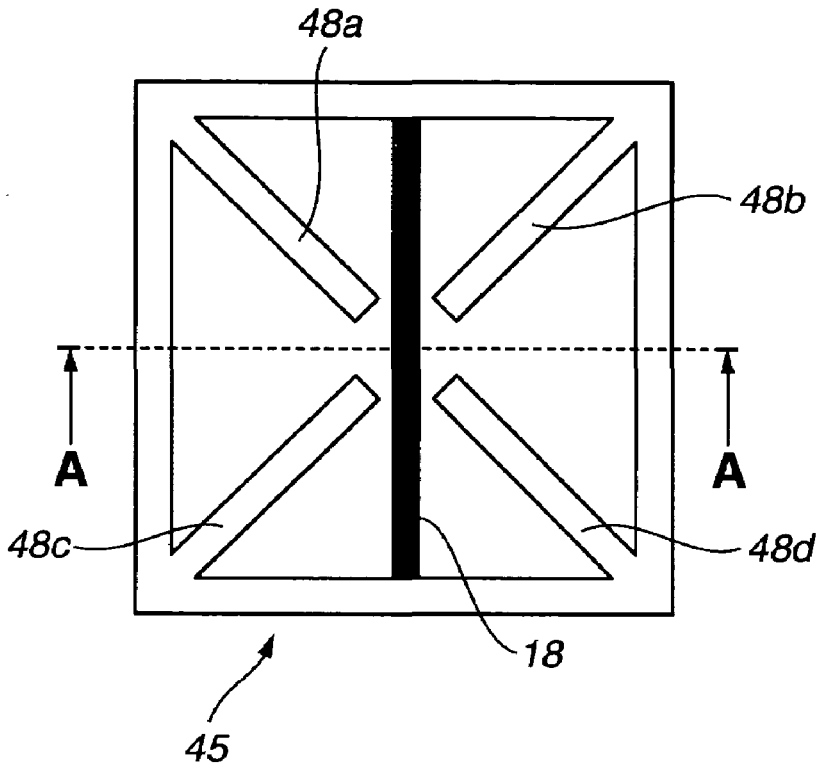
FIGS. 7A and 7B are diagrams illustrating an ink introducing unit of an ink-jet recording cartridge according to a third embodiment of the present invention.
Figure 7B:
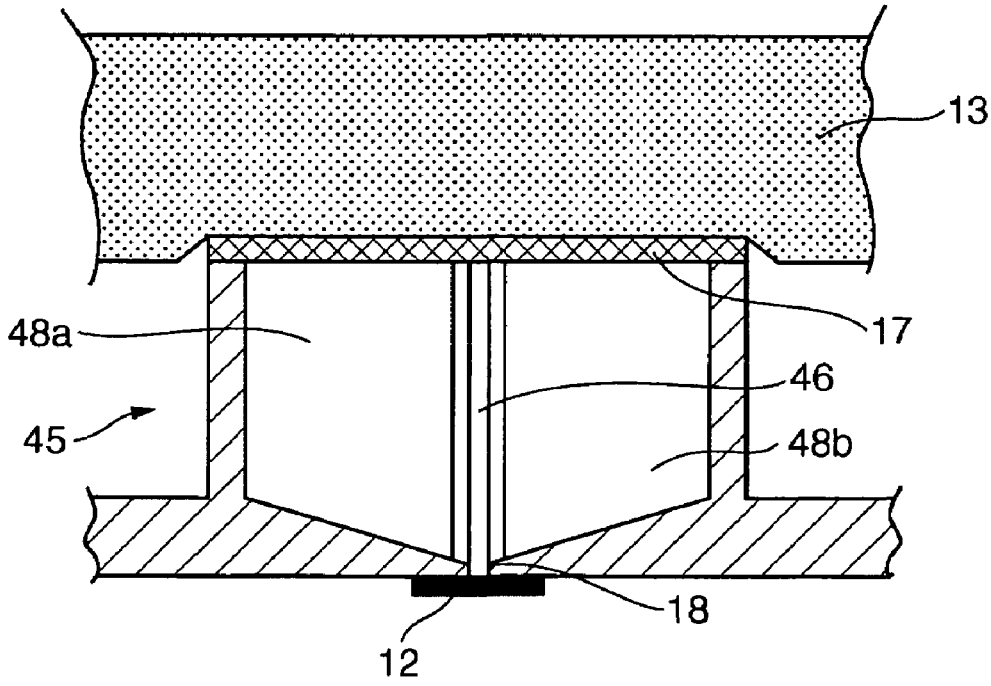

FIGS. 7A and 7B are diagrams illustrating an ink introducing unit of an ink-jet recording cartridge according to a third embodiment of the present invention. FIG. 7A is a plane view in which the ink introducing unit is seen from a filter side, i.e., an ink introducing direction, toward an opening; FIG. 7B is a cross-sectional view taken along line A—A shown in FIG. 7A. Since the ink-jet recording cartridge of the third embodiment has the same basic configuration as the ink-jet recording cartridge 11 of the first embodiment, the same components as those in the first embodiment are indicated by the same reference numerals, and further description thereof will be omitted.

As shown in FIGS. 7A and 7B, within the ink-jet recording cartridge, an ink introducing unit 45 for supplying a recording head 12 with ink from an ink absorber 13 for holding ink, via an ink channel 46 is provided between the recording head 12 and the ink absorber 13.

The ink introducing unit 45 has the shape of a square cylinder. In the ink introducing unit 45, a filter 17 for removing foreign matter within ink contacts one end of the ink absorber 13.

An opening 18 having the shape of a slit is provided at another end of the ink introducing unit 35 facing the recording head 12 so as to surround a nozzle row (not shown) of the recording head 12.

As shown in FIG. 7A, in the ink introducing unit 45, four ribs 48*a*, 48*b*, 48*c* and 49*d* extend from the inner wall surface toward a substantially central portion of the filter 17. These ribs 48*a*, 48*b*, 48*c* and 48*d* are formed in a substantially flat-plate shape at symmetrical positions across the opening 18 by extending toward a substantially central portion of the opening 18. In other words, the four ribs 48*a*, 48*b*, 48*c* and 48*d* extend radially from the substantially central portion of the opening 18.

As shown in FIG. 7B, one end of each of the ribs 48*a*, 48*b*, (48*c* and 48*d* no shown) contacts the filter 17, and another end extends to the opening 18.

Support by the ribs 48*a*, 48*b*, 48*c* and 48*d* prevents deformation of the filter 17, which allows an excellent state of contact with the ink absorber 13 to be maintained. Due to the presence of the ribs 48*a*, 48*b*, 48*c* and 48*d*, even when a bubble (not shown) entering the ink channel 46 grows and occupies a majority of the inside of the ink channel 46, flow of the ink being blocked by the bubble is prevented. Thus, an excellent state of ink supply to the recording head 12 from the ink absorber 13 can be maintained.

Figure 8A:
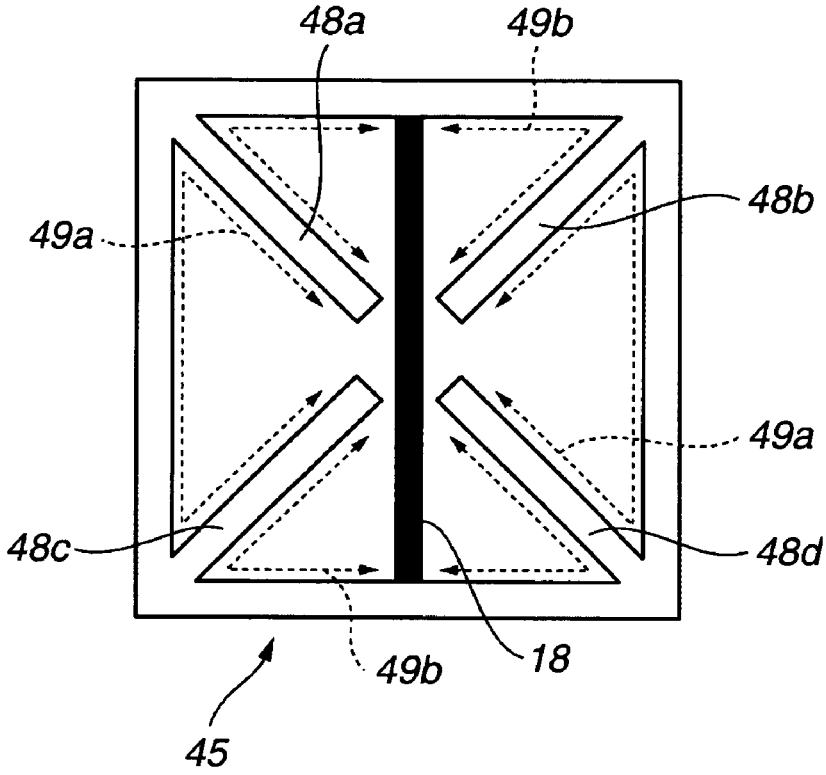
FIGS. 8A and 8B are diagrams illustrating a second ink channel within the ink introducing unit.
Figure 8B:
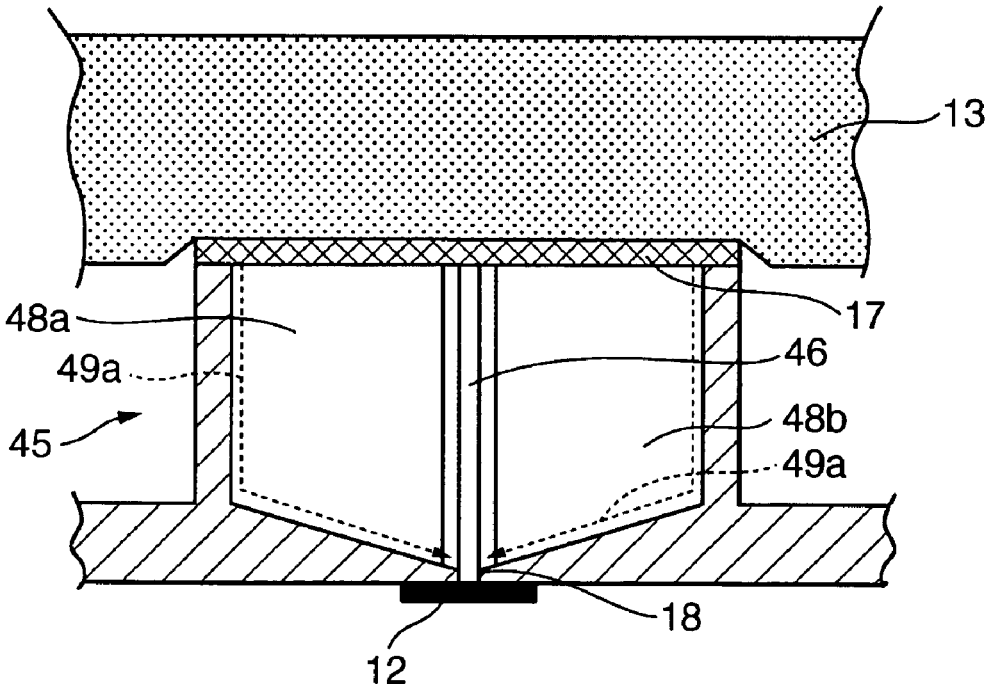
Figure 9A:
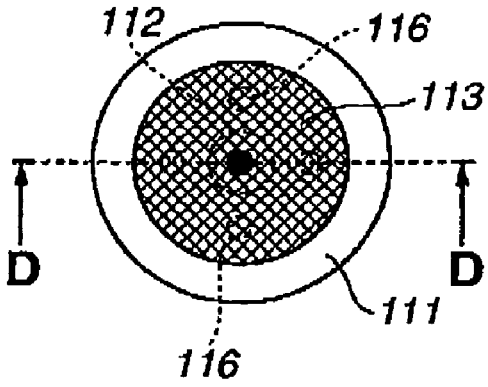
FIGS. 9A–9D are diagrams illustrating an ink introducing unit of a conventional ink-jet recording cartridge.
Figure 9B:
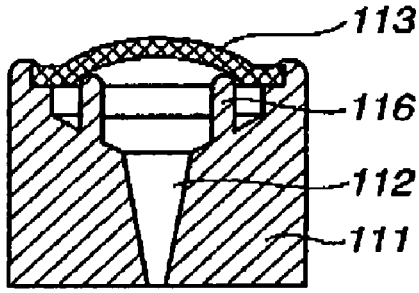
Figure 9C:
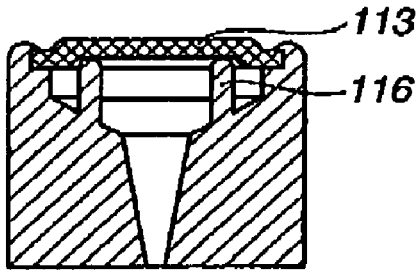
Figure 9D:
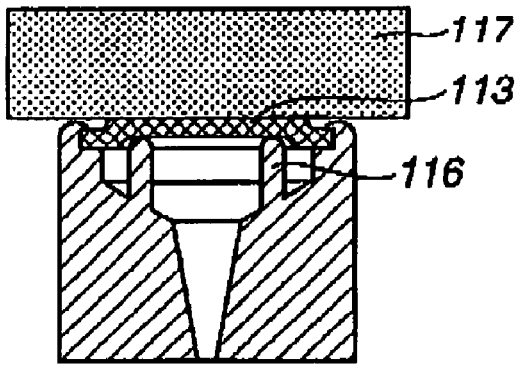

Since corner portions formed by the inner wall surface of the ink introducing unit 45 and sides of the ribs 48*a*, 48*b*, 48*c* and 48*d* have a larger capillary force than the in the ink channel 46, which serves as the main flow, as shown in FIGS. 8A and 8B, a second ink channel 49*a* having a relatively large force to attract ink from the ink absorber 13 is generated along the corner portions. Similarly, at a corner portion formed by the base and the inner wall of the ink introducing unit 45, also, a second ink channel 49*b* having a capillary force larger than in the ink channel 46 is generated along this corner portion.

As a result of the existence of these second ink channels 49*a* and 49*b*, even when a bubble (not shown) entering the ink channel 46 grows and occupies a majority of the ink channel 46, ink is supplied, as indicated by arrows represented by broken lines in FIGS. 8A and 8B, by the second ink channels 49*a* and 49*b* in good balance. Thus, an excellent state of ink supply to the recording head 12 can be maintained.

In the third embodiment, a configuration in which the four ribs 48*a*, 48*b*, 48*c* and 48*d* are provided within the ink introducing unit 45 having the shape of the rectangular cylinder. However, the number of the ribs and the shape of the ink introducing unit may be appropriately selected if necessary within a range so as to be able to maintain an excellent state of ink supply, in accordance with the sizes of the ink-jet recording cartridge, the ink accommodating unit, the recording head, and the like. For example, when the outer shape of the ink introducing unit 15 is large, deformation of the filter may be prevented and increasing the number of the ribs may stabilize the ink supply property.

The opening provided in the ink introducing unit 15 of the ink-jet recording cartridge 11, 31 of each of the above-described first through third embodiments is selected to have the shape of a slit in order to deal with a long nozzle row required for the current tendency toward high-speed recording and a high-quality image. However, any shaped opening that would enable practice of the present invention is applicable.

Although the present invention is applied to an ink-jet recording cartridge in which a recording head is integrated with an ink tank accommodating ink, the present invention may, of course, also be applied to a mere ink tank accommodating ink.

As described above, according to the present invention, by providing a slit-shaped opening and ribs extending from the inner wall of a liquid introducing unit to a substantially central portion of a filter, it is possible to simultaneously prevent deformation of the filter, prevent blocking of supply of a liquid due to a bubble within an ink channel, and secure stability of supply of the liquid.

The individual components shown in outline in the drawings are all well known in the liquid discharge head cartridge arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A liquid discharge head cartridge comprising:

a liquid discharge head for discharging a liquid;

a liquid absorber for holding the liquid;

a liquid introducing unit having a liquid channel for supplying said liquid discharge head with the liquid from said liquid absorber;

an opening provided at a portion of the liquid channel facing said liquid discharge head;

a filter provided at said liquid introducing unit so as to contact said liquid absorber; and a rib extending from an inner wall of said liquid introducing unit to a substantially central portion of said filter, for supporting said filter, wherein said rib extends to said opening.

2. A liquid discharge head cartridge according to claim 1, wherein said opening is slit-shaped.

3. A liquid discharge head cartridge according to claim 1, wherein a plurality of said ribs are provided at said liquid introducing unit.

4. A liquid discharge head cartridge according to claim 1, wherein said rib extends in a direction substantially parallel to a long-side direction of said opening.

5. A liquid discharge head cartridge according to claim 1, wherein a pair of ribs is provided at positions facing across said opening, and wherein an inclined surface for gradually reducing an interval between said facing ribs from said filter toward said opening is formed at each of said pair of ribs.

6. A liquid discharge head cartridge according to claim 4, wherein in said liquid introducing unit, a plurality of ribs extend radially from a substantially central portion of said opening in a long-side direction.

7. A liquid discharge head cartridge according to claim 1, wherein ink is filled in said liquid discharge head cartridge.

8. A recording apparatus that mounts a liquid discharge head cartridge comprising a liquid discharge head for discharging a liquid, a liquid absorber for holding the liquid, and a liquid introducing unit having a liquid channel for supplying said liquid discharge head with the liquid from said liquid absorber, said apparatus comprising:

an opening provided at a portion of the liquid channel facing said liquid discharge head;

a filter provided at said liquid introducing unit so as to contact said liquid absorber; and a plurality of ribs extending from an inner wall of said liquid introducing unit to a substantially central portion of said filter, for supporting said filter, wherein said plurality of ribs extends in a direction substantially parallel to a long-side direction of said opening.

9. A recording apparatus according to claim 8, wherein said opening is slit-shaped.

10. A recording apparatus according to claim 8, wherein said plurality of ribs extends to said opening.

* * * * *